US010755915B2

(12) United States Patent
Ramsey

(10) Patent No.: US 10,755,915 B2
(45) Date of Patent: Aug. 25, 2020

(54) MICROSCALE MASS SPECTROMETRY SYSTEMS, DEVICES AND RELATED METHODS

(71) Applicant: The University of North Carolina at Chapel Hill, Chapel Hill, NC (US)

(72) Inventor: John Michael Ramsey, Chapel Hill, NC (US)

(73) Assignee: The University of North Carolina at Chapel Hill, Chapel Hill, NC (US)

( * ) Notice: Subject to any disclaimer, the term of this patent is extended or adjusted under 35 U.S.C. 154(b) by 0 days.

(21) Appl. No.: 16/403,849

(22) Filed: May 6, 2019

(65) Prior Publication Data

US 2020/0075306 A1 Mar. 5, 2020

Related U.S. Application Data

(63) Continuation of application No. 15/441,702, filed on Feb. 24, 2017, now Pat. No. 10,283,341, which is a continuation of application No. 15/160,471, filed on May 20, 2016, now Pat. No. 9,620,351, which is a continuation of application No. 13/804,911, filed on Mar. 14, 2013, now Pat. No. 9,373,492.

(51) Int. Cl.

| | |
|---|---|
| ***H01J 49/00*** | (2006.01) |
| ***H01J 49/42*** | (2006.01) |
| ***H01J 49/10*** | (2006.01) |

(52) U.S. Cl.

CPC ..... *H01J 49/424* (2013.01); *H01J 49/0022* (2013.01); *H01J 49/10* (2013.01); *Y10T 29/49117* (2015.01)

(58) Field of Classification Search

CPC ..... H01J 49/10; H01J 49/022; H01J 49/025; H01J 49/0036; H01J 49/165; H01J 49/424; Y10T 29/49117

See application file for complete search history.

(56) References Cited

U.S. PATENT DOCUMENTS 6,031,379 A 2/2000 Takada et al.
6,351,983 B1 3/2002 Haas et al.
(Continued)

FOREIGN PATENT DOCUMENTS

WO WO 2009/148711 A1 12/2009

OTHER PUBLICATIONS

Blain et al. "Towards the hand-held mass spectrometer: design considerations, simulation, and fabrication of micrometer-scaled cylindrical ion traps" *International Journal of Mass Spectrometry* 236(1-3):91-104 (2004) (Abstract Only).
(Continued)

*Primary Examiner* — David E Smith
*Assistant Examiner* — Hsien C Tsai
(74) *Attorney, Agent, or Firm* — Myers Bigel, P.A.

(57) ABSTRACT

Mass spectrometry systems or assemblies therefore include an ionizer that includes at least one planar conductor, a mass analyzer with a planar electrode assembly, and a detector comprising at least one planar conductor. The ionizer, the mass analyzer and the detector are attached together in a compact stack assembly. The stack assembly has a perimeter that bounds an area that is between about 0.01 $mm^2$ to about 25 $cm^2$ and the stack assembly has a thickness that is between about 0.1 mm to about 25 mm.

20 Claims, 8 Drawing Sheets

(56) References Cited

U.S. PATENT DOCUMENTS

| | | | | |
|---|---|---|---|---|
| 6,469,298 | B1 | 10/2002 | Ramsey et al. | |
| 6,545,268 | B1 | 4/2003 | Verentchikov et al. | |
| 6,850,403 | B1 | 2/2005 | Gefter et al. | |
| 6,870,158 | B1 | 3/2005 | Blain | |
| 6,933,498 | B1 | 8/2005 | Whitten et al. | |
| 6,967,326 | B2 | 11/2005 | Pai et al. | |
| 6,972,406 | B2 | 12/2005 | Syms | |
| 7,049,583 | B2 * | 5/2006 | Bateman | H01J 49/0418 250/288 |
| 7,121,342 | B2 | 10/2006 | Vinegar et al. | |
| 7,161,142 | B1 | 1/2007 | Patterson et al. | |
| 8,080,085 | B2 | 12/2011 | Hughes et al. | |
| 2005/0042768 | A1 | 2/2005 | Fredrick | |
| 2005/0189488 | A1 * | 9/2005 | Pai | H01J 49/0018 250/292 |
| 2009/0026361 | A1 | 1/2009 | Syms et al. | |
| 2012/0025070 | A1 | 2/2012 | Miller et al. | |

OTHER PUBLICATIONS

International Search Report and Written Opinion for related PCT Application No. PCT/US2014/019289 (22 pages) (dated Jul. 16, 2014).

Kornienko et al. "Field-Emission Cold-Cathode EI Source for a Microscale Ion Trap Mass Spectrometer" *Analytical Chemistry* 72(3):559-562 (2000).

Pau et al. "Microfabricated Quadrupole Ion Trap for Mass Spectrometer Applications" *Physical Review Letters* 96:120801-1-120801-4 (2006).

Whitten et al. "High-pressure ion trap mass spectrometry" *Rapid Communications in Mass Spectrometry* 18:1749-1752 (2004).

* cited by examiner

MICROSCALE MASS SPECTROMETRY SYSTEMS, DEVICES AND RELATED METHODS

RELATED APPLICATIONS

This application is a continuation application of U.S. patent application Ser. No. 15/441,702, filed Feb. 24, 2017, which is a continuation application of U.S. patent application Ser. No. 15/160,471, filed May 20, 2016, which is a continuation application of U.S. patent application Ser. No. 13/804,911, filed Mar. 14, 2013, the contents of which are hereby incorporated by reference as if recited in full herein.

STATEMENT OF GOVERNMENT SUPPORT

This invention was made with government support under the Department of Energy grant number DE-AC05-00OR22725. The United States government has certain rights in the invention.

FIELD OF THE INVENTION

This invention is related to mass spectrometry and is particularly suitable for portable high pressure mass spectrometers.

BACKGROUND OF THE INVENTION

Mass spectrometry is a powerful tool for indentifying and quantifying gas phase molecules. A mass spectrometry system has three fundamental components: an ion source, a mass analyzer and a detector. These components can take on different forms depending on the type of mass analyzer. Interest in portable mass spectrometry (MS) has increased due to potential uses where rapid in situ or field measurements may be of value. Conventional mass spectrometers are unsuitable for these situations because of their large size, weight, and power consumption (SWaP). See, e.g., Whitten et al., *Rapid Commun. Mass Spectrom.* 2004, 18, 1749-52.

There remains a need for portable, compact and light-weight mass spectrometers for chemical monitoring and analysis.

SUMMARY OF EMBODIMENTS OF THE INVENTION

Embodiments of the invention are directed to configurations of fundamental mass spectrometry components into compact packages to reduce size and weight of the overall system.

Embodiments of the invention provide systems, methods and devices configured to provide compact, light-weight high pressure mass spectrometers that may facilitate field use.

Some embodiments are directed to assemblies for a mass spectrometry system. The assemblies include: (a) an ionizer including at least one planar conductor; (b) a mass analyzer including a planar electrode assembly; and (c) a detector including at least one planar conductor. The ionizer, the mass analyzer and the detector are attached together in a compact planar stacked assembly. The stacked assembly has a perimeter that bounds an area that is between about 0.01 $mm^2$ to about 25 $cm^2$ and has a thickness that is between about 0.1 mm to about 25 mm.

The ionizer, detector and mass analyzer can be configured as respective cooperating ionizer arrays, detector arrays and mass analyzer arrays.

The detector at least one planar conductor can include a Faraday cup electrode.

The Faraday cup electrode, where used, can include a thin conductive film on a substrate.

The ionizer planar conductor can be configured to cooperate with the detector to define a collection electrode for the Faraday cup.

The Faraday cup electrode can include a conductive layer with a substantially continuous conductive surface.

The mass analyzer can include an ion trap. The detector can be configured with the at least one planar electrode to include a Faraday cup electrode that has a conductive layer in a shaped pattern of conductive regions that overlie and align with corresponding apertures in an adjacent electrode of the ion trap.

The substrate of the Faraday cup electrode can be a semiconductor forming an integrated circuit. The conductive layer can include a single trace or strip that connects each conductive region to an electronic collector.

The ionizer can include a pair of planar conductors that define array electrodes separated by an insulator.

The mass analyzer can include an ion trap array. A first endcap electrode of the ion trap array can define one of the at least one planar electrode of the ionizer.

The assembly may include an Einzel lens comprising a plurality of spaced apart electrodes residing between the ionizer and the mass analyzer.

The mass analyzer can be a cylindrical ion trap. The Einzel lens electrodes can be configured as an array of lens apertures that align with corresponding apertures of the ion trap. The Einzel lens apertures can have a size that substantially correspond to an aperture size of the ring electrode.

The assembly can include at least one planar grid that resides between either (or both if more than one grid) (i) the mass analyzer and the detector or (ii) the mass analyzer and the ionizer.

The assembly can include first and second planar grids, the first grid residing between the mass analyzer and the detector and the second grid residing between the mass analyzer and the ionizer.

The stacked assembly can include between 7-100 stacked conductive and insulating layers that form the mass analyzer, ionizer and detector.

The mass analyzer can include a planar ring electrode and first and second opposing planar endcap electrodes. The ion trap can have an aperture array of at least 10 spaced apart apertures with centers of adjacent apertures residing between about 1 μm to about 5000 μm apart.

The detector at least one planar electrode can include a conductor on an integrated circuit amplifier.

The mass analyzer can include a CIT with concentric arrays of apertures.

The CIT can include at least one mesh endcap.

The detector at least one planar conductor can include at least one of the following: a single conductor, a single conductor on an insulator, an array of conductors that are connected or addressable by an amplifier.

Other embodiments are directed to portable high-pressure mass spectrometers. The portable devices include a housing and at least one chamber inside the housing. A compact stacked assembly is held inside the chamber. The compact stacked assembly includes: (a) an ionizer comprising at least one planar conductor; (b) a mass analyzer comprising a planar electrode assembly; and (c) a detector comprising at least one planar conductor. The device also includes a drive RF power source in the housing in communication with the mass analyzer and a control circuit held by the housing configured to control activation and/or deactivation of the ionizer, the drive RF power source, and the detector. The compact stack assembly has a perimeter that bounds an area that is between about 0.1 $mm^2$ to about 25 $cm^2$ and has a thickness that is between about 0.1 mm to about 25 mm.

The mass analyzer can include an ion trap with a planar ring electrode and first and second opposing planar endcap electrodes. The ion trap can have an aperture array of at least 10 spaced apart apertures with centers of adjacent apertures residing between about 1 μm to about 5000 μm apart.

The mass spectrometer of claim 21 can also optionally include an axial RF power source held inside the housing and electrically connected to the mass analyzer. The control circuit can be configured to control operation of the axial RF power source.

The mass spectrometer can include a pressurized buffer gas source in fluid communication with the housing for providing a buffer gas to the chamber.

The housing can be configured to controllably receive ambient air as buffer gas in the chamber.

The spectrometer can be configured to be a hand-held, light weight spectrometer having a weight between about 1-15 pounds, exclusive of a vacuum pump, and wherein the mass spectrometer chamber is a vacuum chamber that is configured to operate at high pressure of about 100 mTorr or greater.

The housing can be sized and configured as a handheld housing with a display and a user interface with a display providing a user interface (UI) or in communication with a UI.

The mass spectrometer can include an axial RF power source is configured to apply a low voltage axial RF input signal to an endcap electrode or between the two endcap electrodes of the mass analyzer during a mass scan.

The planar conductor of the detector can be configured as a Faraday cup electrode that comprises a conductive layer on a semiconductor substrate with a substantially continuous conductive surface.

The compact stacked assembly perimeter can bound an area that is between about 0.1 $mm^2$ to about 10 $cm^2$. The compact stacked assembly can have a thickness that is between about 0.1 mm to about 10 mm.

The compact stacked assembly can include between 7-100 stacked conductive and insulating layers that form the mass analyzer, ionizer and detector.

The compact stacked assembly can include at least one planar grid and at least one planar lens assembly.

The mass analyzer can be an ion trap. The at least one planar electrode of the detector can include a Faraday cup electrode that has a conductive layer in a shaped pattern of conductive regions that overlie and align with corresponding apertures in an adjacent electrode of the ion trap.

The conductive layer can have a single trace or strip that connects each conductive region to an electronic collector.

The ionizer can include a pair of planar conductors that define electrodes separated by an insulator.

The mass analyzer can include an ion trap. A first electrode of the ion trap can define one of the at least one planar electrode of the ionizer.

The mass spectrometer stacked assembly can also include an Einzel lens comprising a plurality of spaced apart electrodes residing between the ionizer and the mass analyzer.

The mass analyzer can be a cylindrical ion trap. The Einzel lens electrodes can include an array of lens apertures that align with corresponding apertures of the ion trap.

The compact stacked assembly can include at least one planar grid that resides between either (i) the mass analyzer and the detector or (ii) the mass analyzer and the ionizer.

The mass analyzer can include a CIT.

The CIT can include concentric arrays of apertures.

The CIT can include at least one mesh endcap.

The detector at least one planar conductor can include a conductor on an integrated circuit amplifier.

The mass analyzer can be a mass analyzer array, the ionizer can be an ionizer array and the detector can be a detector array.

At least one of the at least one ionizer planar conductor is configured to cooperate with the detector to define a collection electrode for a Faraday cup associated with the detector.

The mass spectrometer can be configured so that the ionizer, mass analyzer and detector operate at near isobaric conditions and at a pressure that is greater than 100 mTorr.

Still other embodiments are directed to methods of fabricating an assembly for a mass spectrometer system. The methods include: (a) providing a mass analyzer comprising an electrode assembly of planar electrodes; (b) providing a detector comprising a planar conductor; (c) providing an ionizer comprising planar conductive and insulating layers; and (d) stacking the mass analyzer electrode assembly, the detector and the ionizer together to form a stacked integral assembly having a perimeter that bounds an area between 0.01 $mm^2$ to 25 $cm^2$ and a stack thickness of between about 0.1 mm to about 25 mm.

The compact stacked assembly can include between 7-100 stacked conductive and insulating layers that form the mass analyzer, ionizer and detector.

The mass analyzer can be an ion trap that comprises a high density of through apertures with centers of adjacent apertures spaced apart between about 1 μm to about 5000 μm.

The method can include providing an Einzel lens and placing the Einzel lens between the ionizer and the mass analyzer during the stacking of the integral assembly.

The detector planar conductor can be a thin conductive film on a substrate, and the providing the detector step can be carried out by orienting the thin conductive film to face an endcap electrode of the mass analyzer for the stacking.

The method can include providing at least one planar grid and placing the at least one planar grid between the ionizer and the mass analyzer and/or between the mass analyzer and the detector for the stacking step.

The detector at least one planar conductor can be a conductor on an integrated circuit amplifier.

The mass analyzer can include a CIT with concentric arrays of apertures, the method can include aligning the apertures before or during the stacking step.

The CIT can include at least one mesh endcap.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim and/or file any new claim accordingly, including the right to be able to amend any originally filed claim to depend from and/or incorporate any feature of any other claim or claims although not originally claimed in that manner. These and other objects and/or aspects of the present invention are explained in detail in the specification set forth below. Further features, advantages and details of the present invention will be appreciated by those of ordinary skill in the art from a reading of the figures and the detailed description of the preferred embodiments that follow, such description being merely illustrative of the present invention.

DESCRIPTION OF EMBODIMENTS OF THE INVENTION

Figure 1A:
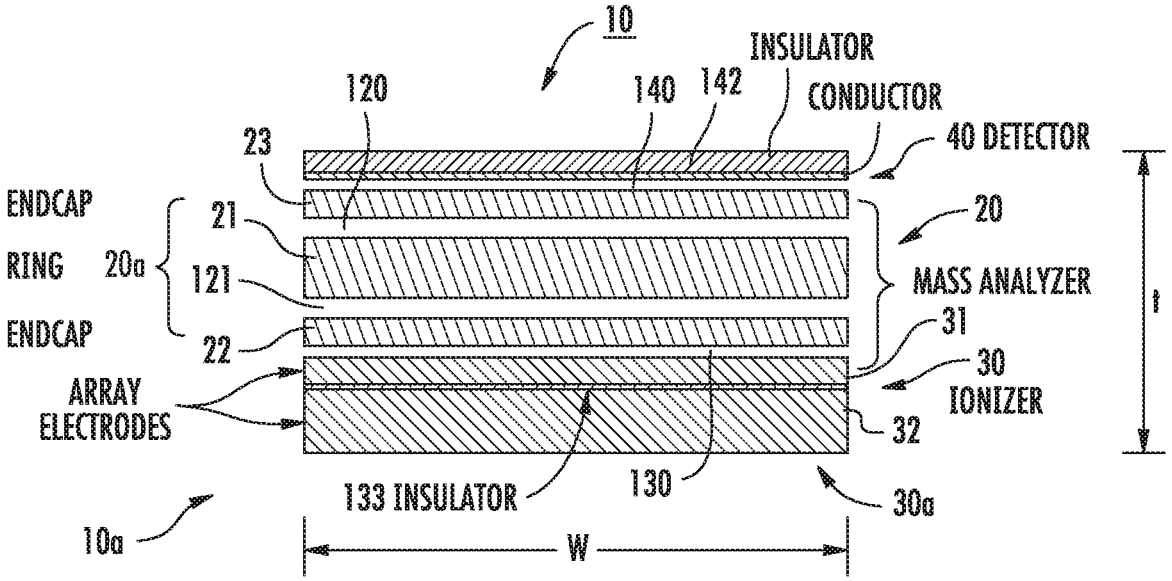
FIG. 1A is an enlarged schematic illustration of a side view of an example of a compact, stacked assembly of planar components that provide an ion source, mass analyzer and detector according to embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations unless specified otherwise. In addition, the sequence of operations (or steps) is not limited to the order presented in the figures and/or claims unless specifically indicated otherwise. In the drawings, the thickness of lines, layers, features, components and/or regions may be exaggerated for clarity and broken lines illustrate optional features or operations, unless specified otherwise.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "comprises," "comprising," "includes," and/or "including" when used in this specification, specify the presence of stated features, regions, steps, operations, elements, and/or components, but do not preclude the presence or addition of one or more other features, regions, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when a feature, such as a layer, region or substrate, is referred to as being "on" another feature or element, it can be directly on the other feature or element or intervening features and/or elements may also be present. In contrast, when an element is referred to as being "directly on" another feature or element, there are no intervening elements present. It will also be understood that, when a feature or element is referred to as being "connected", "attached" or "coupled" to another feature or element, it can be directly connected, attached or coupled to the other element or intervening elements may be present. In contrast, when a feature or element is referred to as being "directly connected", "directly attached" or "directly coupled" to another element, there are no intervening elements present. Although described or shown with respect to one embodiment, the features so described or shown can apply to other embodiments.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the present application and relevant art and should not be interpreted in an idealized or overly formal sense unless expressly so defined herein. Well-known functions or constructions may not be described in detail for brevity and/or clarity.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The term "about" means that the stated number can vary from that value by +/−10%.

The term "analyte" refers to a molecule or chemical(s) in a sample undergoing analysis. The analyte can comprise chemicals associated with any industrial products, processes or environments or environmental hazards, toxins such as toxic industrial chemicals or toxic industrial materials, and the like. Moreover, analytes can include biomolecules found in living systems or manufactured such as biopharmaceuticals.

The term "mass resonance scan time" refers to mass selective ejection of ions from the ion trap with associated integral signal acquisition time.

Embodiments of the invention are directed to compact configurations/packaging of the fundamental components of a device that determines ion mass to charge ratio and can additionally provide relative abundance information for a number of ions ranging across mass to charge values. The specific examples described herein are particularly relevant to ion trap mass analyzers but may be relevant to other types of mass analyzers. Generally, stated, the arrangement of the ionizer components and/or detector components with respect to the mass analyzer components allows significant reductions in size and weight over current designs.

Referring now to the figures, FIG. 1A shows a compact mass spectrometer assembly 10 that includes the ionization source 30, a mass analyzer 20 (such as, but not limited to, an ion trap mass analyzer), and the detector 40, all arranged as a releasably attached set or integrally attached unit of stacked planar conductor and insulator components, e.g., typically alternating conductive and insulating films, substrates, sheets, plates and/or layers or combinations thereof, with defined features for the desired function.

The assembly 10 can have a compact planar shape, typically having a perimeter that bounds an area that is between about 0.01 $mm^2$ to about 25 $cm^2$, including between about 0.01 $mm^2$ and 10 $cm^2$ and including between about 0.1 $mm^2$ and about 10 $mm^2$. For stack assemblies having polygonal perimeter shapes, the sides can be between about 0.1 mm to 10 cm, which may be in width and length dimensions "W" and "L". In some embodiments, each perimeter side (e.g., W and L) can be between about 0.1 mm to about 5 cm.

The thickness "t" can be between about 0.01 mm to about 25 mm, including between 0.1 mm and 25 mm, between 0.25 mm and 25 mm, and between 0.1 mm and 1 mm. The thickness "t" can be about 0.1 mm, about 0.2 mm, about 0.3 mm, about 0.4 mm, about 0.5 mm, about 0.6 mm, about 0.7 mm, about 0.8 mm, about 0.9 mm, about 10 mm, about 11 mm, about 12 mm, about 13 mm, about 14 mm, about 15 mm, about 16 mm, about 17 mm, about 18 mm, about 19 mm, about 20 mm, about 21 mm, about 22 mm, about 23 mm, about 24 mm, and about 25 mm.

The different components and/or alternating conductors and insulators can be clamped together, brazed, adhesively attached, formed as stacked substrates, or bonded or otherwise attached or formed to have the proper alignment of the apertures and other features (e.g., lens, detector surface, etc. . . . ).

The mass analyzer 20 can be configured in layers forming CITs, rectilinear ion traps, linear quadrupoles, Wien filters, or any other type of mass analyzer that could be implemented with patterned planar conducting and insulating layers.

Figure 1B:
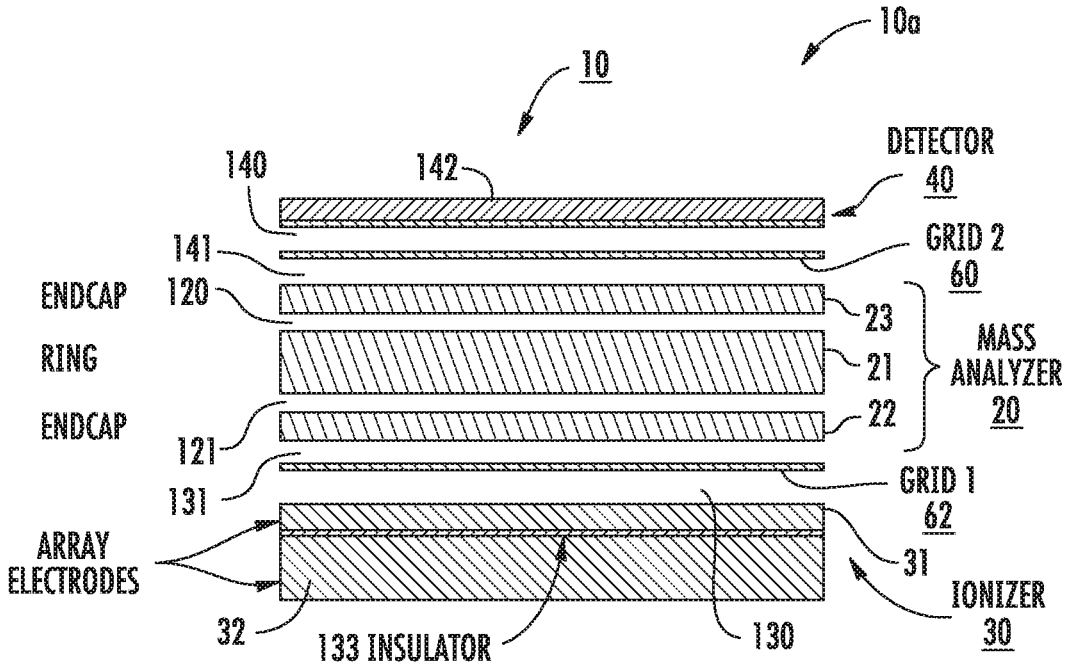
FIG. 1B is an enlarged schematic illustration of a side view of another example of a compact, stacked assembly of planar components that provide an ion source, mass analyzer and detector according to embodiments of the present invention.

FIG. 1B shows an assembly 10 similar to that shown in FIG. 1A, but with the inclusion of two planar conductive grids 60, 62. One grid 60 can be placed intermediate the electrode 23 and the detector 40 and the other, where used, can be placed intermediate the electrode 22 and the ion source (e.g., electrode 31). An insulator 141, 131 can reside between the respective grid 60, 62 and the corresponding respective electrode 23, 22. The assembly 10 can omit one or both of these grids 60, 62. As is known to those of skill in the art, a "grid" refers to a conductive planar sheet with a pattern of apertures or open windows, in a defined geometric shape, typically the grid apertures have a constant size and shape (which can be smaller or larger than the ion sources and the end cap apertures but typically smaller). The grid 60, 62 can be biased to turn the conduction of charged particles on or off by appropriately controlling the electric potentials of the grids relative to their adjacent electrodes. The device could be operated with either grid 60, 62 or with both grids (or no grids). The grid can be rectangular and extend across a width and length dimension substantially commensurate with the array of electrodes 21, 22, 23. The grids 60, 61 can have a smaller thickness than the respective adjacent electrode 23, 22 and/or 31.

Figure 7:
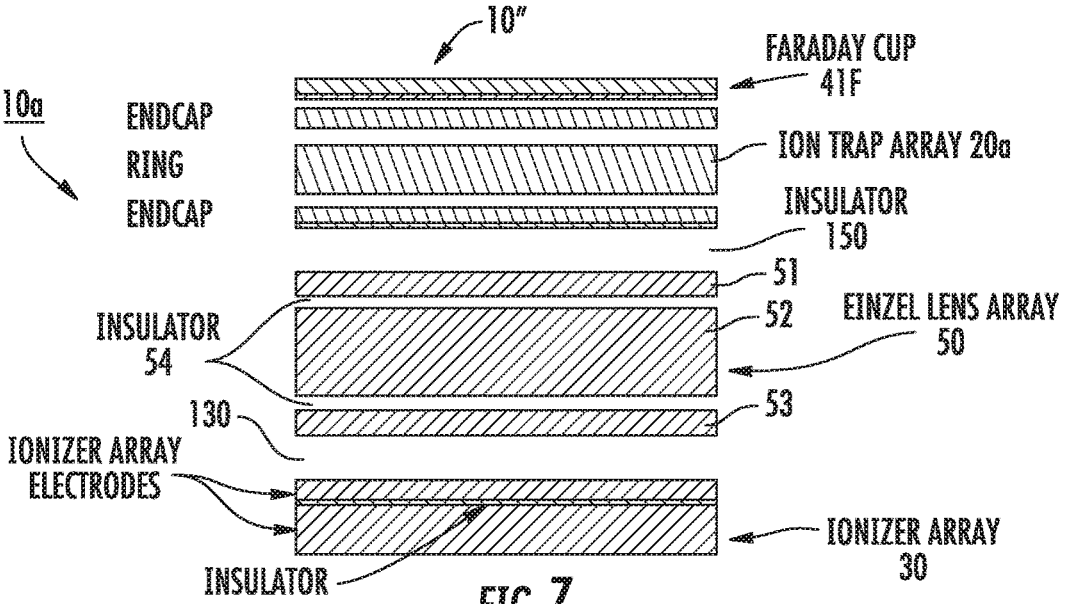
FIG. 7 is a schematic illustration of another stacked assembly according to embodiments of the present invention.

As will be discussed further below, as shown in FIG. 7, the planar stacked assembly 10 can include additional components, such as a planar lens 50, all in the same compact package or foot print dimensions noted.

Examples of conductors for the various conductive components, e.g., the CIT electrodes 21, 22, 23, the detector electrode(s) 41 (FIGS. 4A, 5A), the ionizer electrodes 31, 32 and lens conductors 51, 52, 53 (where used) include, but are not limited to, one or more of metals such as brass, stainless steel, copper, Beryllium copper, gold, plated or coated metals or substrates such as stainless steel with one-sided gold plating (Au/SS), doped semiconductors, typically n or p heavily doped silicon (Si), germanium (Ge) or Arsenic-doped germanium semiconductor (GaAs). The conductors can be a solid (e.g., continuous surface) conductor or a mesh conductor or thin films of conductive material on a substrate.

The term "thin film" refers to coatings that have a thickness of between about 1 nm to about 10 μm.

Examples of insulators for the various insulator components, e.g., the CIT insulators 120, 121, the detector insulators 140, 142, the ionizer insulators 130, 133 and the lens insulators 54, 150 (where used) include, but are not limited to, one or more of Teflon®, mylar, mica, insulating ceramics, polyimide, macor, kapton, $SiO_2$, $Si_3N_4$ and ambient gas surrounding the electrode stack 10 in a chamber, said chamber could possibly be at reduced pressures compared to ambient. The term "insulator" refers to an electrical insulator and can comprise a solid substrate, a mesh substrate, a patterned substrate with spatial elements removed, a thin film coating of a suitable material on a conductor surface or a gas.

In some embodiments, all of the alternating planar insulator and conductive layers are stacked so that adjacent conductive and insulating layers are in intimate, abutting contact. The stacked insulating and conductive layers can be provided in any suitable numbers to provide the source, mass analyzer and detector components, typically between about 7-100 layers, and more typically between 15 and 50 layers. In some embodiments, the cumulative number of insulator and conductor layers in a stack can be 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49 and 50, or about 50, about 60, about 70, about 80, about 90 and about 100 layers. A plurality of, a majority of, or even all the layers can be provided on one or more semiconductor substrates as an integrated circuit.

As shown in FIGS. 1A, 1B, 2A, 2B and 2C, the ion trap mass analyzer 20 can be a cylindrical ion trap (CIT) array 20*a*. The CIT array 20*a* includes three closely spaced apart electrodes (conductors) as is well known. The three electrodes include a center ring electrode 21 residing between two endcap electrodes 22, 23. The term "array" refers to cooperating planar components of the assembly 10*a*. The term "aperture array", when used with CIT, for example, means that the CIT electrodes (or other component electrode/planar conductor) have axially aligned apertures with a distance between centers of adjacent apertures having a distance "b". The apertures can be arranged in a regular pattern or random. The ring electrode apertures 21*a* will generally be larger than the first or second endcap electrode apertures 22*a*, 23*a*. The term "ring electrode" refers to the center electrode in the ion trap array that is between the endcap or end electrodes 22, 23 and is not required to have a ring shape form factor, e.g., either in an outer perimeter or in a bounding channel of a respective ion trap. As is well known, a respective ion trap has a tubular channel of different diameters of aligned endcap and ring apertures.

Figure 2A:
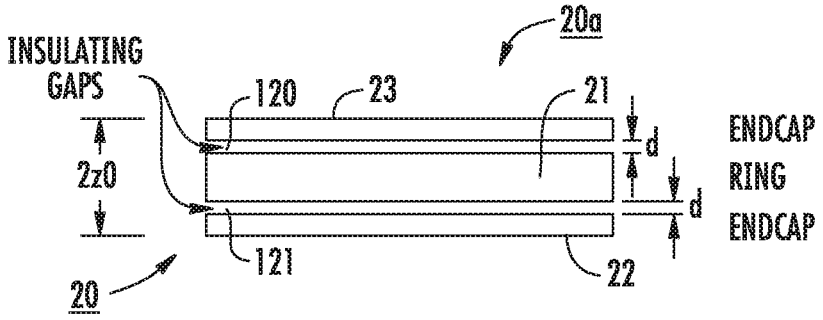
FIG. 2A is a schematic illustration of a side view of an ion trap array shown in FIGS. 1A and 1B.
Figure 2B:
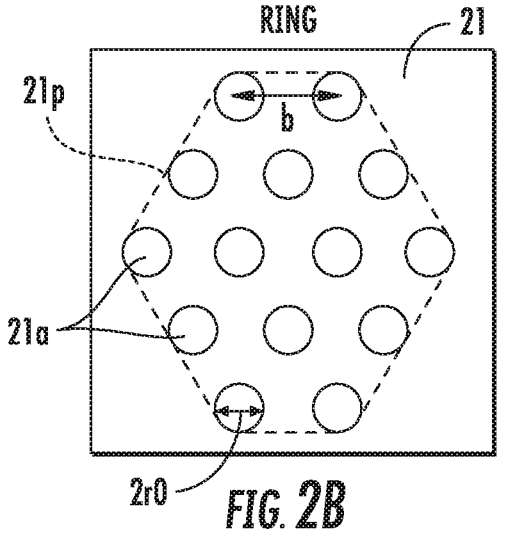
FIG. 2B is a top view of an example of a ring electrode of the ion trap array shown in FIG. 2A according to embodiments of the present invention.

As shown in FIGS. 2A and 2B, the ring electrode 21 has a plurality of closely spaced through-apertures 21*a*. The neighboring insulators 120, 121 can have apertures that are aligned with and are substantially the same size or larger than those of the ring electrode 21 or may have apertures that reside just around or proximate the outer perimeter of member 21, outside the array of apertures 21*a*. The apertures 21*a* each have a radius $r_0$ or average effective radius (e.g., the latter calculates an average hole size using shape and width/height dimensions where non-circular aperture shapes are used) and a corresponding diameter or average cross distance $2r_0$. In some embodiments, the array 20*a* has an effective length $2z_0$ measured as the distance between interior surfaces of endcaps. The array 20*a* can be configured to have a defined ratio of $z_0/r_0$ that is near unity but is generally greater than unity by a few tens of percent. The $r_0$ and $z_0$ dimensions can be between about 0.5 μm to about 1 cm but for microscale mass spectrometry applications contemplated by preferred embodiments of the invention, these dimensions are preferably 1 mm or less, down to about 0.5 μm.

Each aperture 21*a* can be axially aligned with a corresponding aperture 22*a*, 23*a* of each of the adjacent end cap electrodes 22, 23 (and insulators 120, 121 where similar configurations of apertures are used) so that centers of each aperture 21*a*, 22*a*, 23*a*, even with different size apertures, are aligned.

There can be a corresponding number of apertures 21*a*, 22*a*, 23*a* on each of the ring 21 and endcap electrodes 22, 23. Endcap electrodes 22, 23 typically have through holes or apertures 22*a*, 23*a* in them that are located axially symmetric about the ring electrode hole or holes 21*a* with a diameter or average effective radius (e.g., (width+height)/2) that is smaller than that of the ring electrode apertures, such as between about 10-40%, typically between about 10-30%, and more typically between about 20-30% of the diameter or width of the respective aperture 21*a* of the ring electrode 21. In alternative embodiments, the endcap apertures, 22*a* and 23*a* can have diameters similar to, or larger than the ring aperture 21*a*. In the case of these latter endcap aperture dimensions the apertures would typically be covered by a conductive mesh that is in electrical contact with the endcap electrode. The aperture array 20*a* can be in any pattern and the apertures 22*a*, 23*a* can have any suitable shape as long as the ring to end endcap holes 21*a* to 22*a* and 21*a* to 23*a* are substantially (predominantly) axially aligned and symmetric. Different electrodes 21, 22, 23, can have different aperture geometry, but preferably similar geometries excepting in cases where mesh is used with endcap electrodes.

Figure 2C:
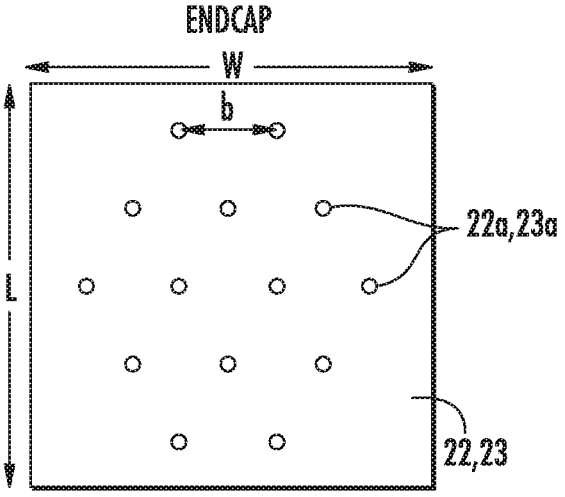
FIG. 2C is a top view of an example of an endcap electrode for the ion trap array shown in FIG. 2A according to embodiments of the present invention.

The aperture array 20*a* can be provided in a relatively high-density pattern of apertures. As shown in FIGS. 2B and 2C, the array of apertures can be formed so that outer apertures define a perimeter shape 21*p* that is substantially hexagonal with apertures in a closely-arranged pattern. This arrangement is an efficient use of electrode area. The center-to-center spacing, b, of the apertures must be greater than $2r_0$. In some embodiments, the distance "b" between neighboring apertures 21*a*, 22*a*, 23*a* on respective electrodes can be 10% larger than $2r_0$ and in other embodiments b may be 50-100% larger than $2r_0$. A corresponding number of apertures can be provided in the electrodes and solid or mesh insulator of the ionizer array 30 and conductor components of the lens 50, where used. The lens 50 can have apertures that are typically 1-1 with the ion trap and the ionizer features can be smaller than trap dimensions so there could be a plurality of ionizer features per ion trap.

As shown in FIG. 2A, the endcap electrodes 22, 23 are spaced a distance d away from the ring electrode 21, typically in symmetric spacings. The specific spacing depends on the ring electrode thickness, but a distance spacing of the endcap electrodes 22, 23 can be chosen to optimize mass spectrometry performance. This distance is typically chosen such that $z_0$ is slightly larger than $r_0$, typically 10-30% larger. Electrical insulators 120, 121 with corresponding apertures separate the electrodes 21, 22, 23. A respective insulator 120, 121 can comprise a gas, a solid material, or a combination of the two. In some particular embodiments, the insulators 120, 121 are one or more sheets of insulating substrate material with material removed so as to not interfere with the ring electrode apertures. The endcap apertures or holes 22*a*, 23*a* allow the injection of ionization energy or ions and the ejection of ions for detection purposes. Typically one end electrode would be used for injection of ions or ionizing energy (through one end electrode 22) and the other end for ejection of ions (through the other end electrode 23).

In some embodiments, the ring electrode 21 can be between about 500 μm to about 790 μm thick and the endcap electrodes 22, 23 can be the same or less thick than the ring electrode, typically thinner, such as between about 10-50% the thickness of the ring electrode, e.g., about 250 μm thick. The spacing between electrodes can be set with polyimide washers (McMaster-Carr) to create a CIT 20 with desired critical dimensions, e.g., $r_0$=500 μm, $z_0$=645 μm. For further discussion of CIT configurations, see U.S. Pat. Nos. 6,933,498, and 6,469,298, the contents of which are hereby incorporated by reference as if recited in full herein. The ionizer 30 includes one or more planar conductors (e.g., electrode 31 and/or 32). An example of a single electrode ionizer is described in Kornienko, Anal. Chem. 2000, 72, 559-562, the contents of which are hereby incorporated by reference as if recited in full herein.

Figure 3A:
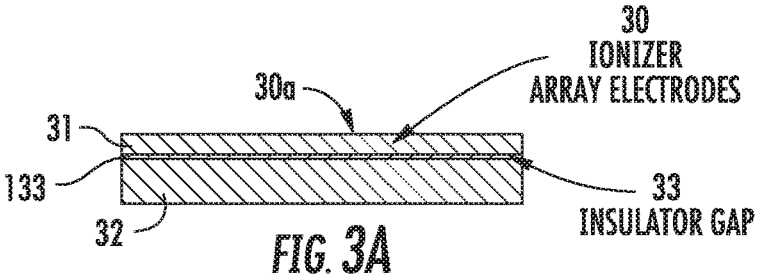
FIG. 3A is a schematic illustration of a side view of the ion source shown in FIGS. 1A and 1B.
Figure 3B:
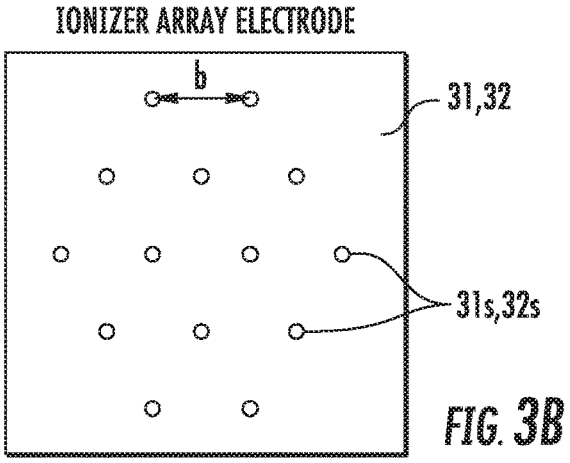
FIG. 3B is a top view of the device shown in FIG. 3A according to embodiments of the present invention.

As shown in FIGS. 3A and 3B, an exemplary ionizer (or ion source) 30 can comprise an ionizer array 30*a* that includes closely spaced electrodes 31, 32, separated by an intermediately positioned insulator 133. The insulator 133 can comprise an electrically insulating or non-conductive substrate or material layer or layers and/or a gap space (if the latter, the gap space can be filled by air or a buffer gas, typically at mass spectrometer vacuum, in operation). The term "ionizer array electrodes" indicates that the electrodes 31, 32 provide a plurality of spaced apart sources 31*s*, 32*s* aligned with and symmetrically arranged with the array of ion traps.

The ionization source 30 for an array of ion traps 20*a* can be a planar array of areas or zones that can lead to the production of ions for each of the CITs in the CIT array. FIGS. 3A and 3B shows an exemplary design of an array ion source 30 where each light circular feature represents an ion source or sources 31*s*, 32*s*. Within each ion source 31*s*, 32*s*, there may be contained therein a plurality of apertures with lateral dimensions that can range from 10 μm down to about 1 μm, that act as sources of ions or electrons. The array of ionizers can have the same spatial pitch as the CIT array 20*a*. Examples of types of ionization that can be provided in array form include, but are not limited to, cold field electron emitters, miniature gas plasma sources, and field ionization. In particular embodiments, as shown in FIG. 3A, the ionization source 30 comprises two planar conductors 31, 32 spaced apart by an insulator 33. An array of micron-scale holes can be formed within the insulator 133 corresponding to the indicated ionization regions 31*s*, 32*s*. Applying an appropriate magnitude electrical potential between the two conducting electrodes 31, 32 can generate electric field strengths to affect cold field emission of electrons, formation of a gas plasma, or field ionization of molecules or atoms. The close spatial proximity of the ionization array to the mass analyzer, such as the CIT described, is particularly advantageous for small mass spectrometry systems operating at high pressure (approximately >1 Torr) due to the reduced mean free paths experienced by the ions or electrons at such pressures.

Figure 4A:
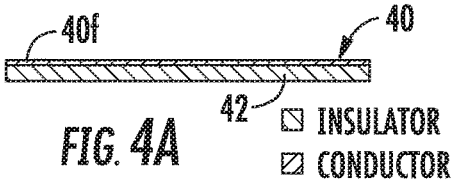
FIG. 4A is a schematic illustration of a side view of an exemplary detector suitable for the stacked assembly shown in FIGS. 1A and 1B.
Figure 4B:
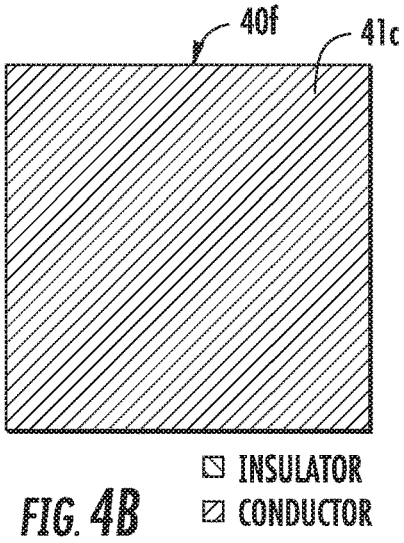
FIG. 4B is a top view of the detector shown in FIG. 4A according to embodiments of the present invention.

It is well known that CITs 20 generate mass spectral information by ejecting an ensemble of trapped ions in an orderly fashion such that ions of a given mass to charge range are ejected through the endcap holes 23*a* during a defined or selected time period. Thus, the detector 40 comprises an appropriate transducer. The transducer typically comprises an electron multiplier but may be a planar detector 40 as shown in FIGS. 1A, 1B, 4A and 5A. In particular embodiments, as shown in FIGS. 4A and 4B, the detector 40 comprises a Faraday cup configuration. However, other planar detectors may be used.

Figure 5A:
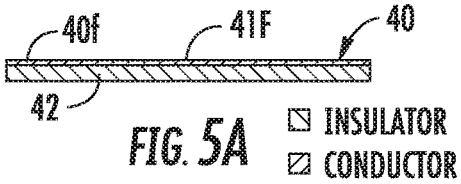
FIG. 5A is a schematic illustration of a side view of another exemplary detector suitable for the stacked assembly shown in FIGS. 1A and 1B.
Figure 5B:
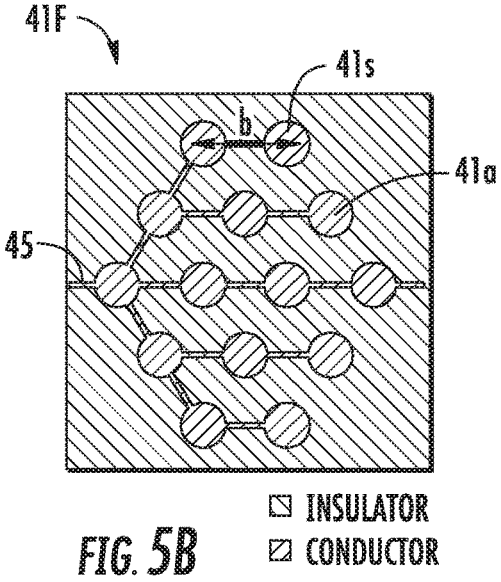
FIG. 5B is a top view of the detector shown in FIG. 5A according to embodiments of the present invention.

Referring to FIGS. 4A and 5A, in some embodiments, the detector 40 may comprise a thin conductive film 40*f* on an insulating substrate 42. FIGS. 4A and 4B illustrate an example of a planar detector 40 that has either a single charge sensitive site that collects ions from all traps from the CIT array 20*a*. FIGS. 5A and 5B illustrate an example of a planar detector 40 with an array 41*a* of charge collection sites 41*s* that can be used as a Faraday cup detector 41F. The planar conductive detector 40 can comprise a thin conductive film 40*f* on in contact with a non-conductive or insulating thin film or substrate 42. The non-conductive film could be a thin layer of silicon dioxide or silicon nitride supported by a silicon wafer. Moreover, the substrate can be a semiconductor substrate such as a silicon wafer that could contain the electrical amplifying circuitry for amplifying the collected charge into a signal that could be measured by an analog to digital conversion chip connected to an electrical controller and signal processor.

Charge detection provided by the planar detector 40 may be particularly attractive for small mass spectrometry systems due to their inherently small size and weight and the ability to operate at pressures from low vacuum to atmospheric pressure. Charges collected by the conductive film 40*f* or other conductor associated with the detector 40 can be measured either with an electrometer or a charge sensitive transimpedance amplifier. The term "electronic collector" refers to an electronic circuit that can detect charges collected by the film and/or conductor.

For example, the detector 40 can be configured to detect ions ejected in parallel from a planar CIT array with a planar electrode with a solid continuous conductive surface 41*c* over the holes of the endcap electrode 23*a* as shown in FIGS. 4A and 4B. The gain of a charge sensitive transimpedance amplifier may be improved with reduced Faraday cup capacitance. Thus, a Faraday cup conductor 41F can be used. The Faraday cup 41F can be configured as an array of conductive Faraday cups 41*a* with geometrically shaped collection sites 41*s* as shown in FIGS. 5A and 5B which in some embodiments may be preferable. The array of Faraday cups 41*a* can have a single electrical trace or connection 45 to an amplifier so as to be connected in parallel as shown in FIG. 5B or they can be addressed separately by separate electronic amplifiers (with separate electrical traces or connections) or by a single amplifier through a multiplexer. An insulating material 42 and/or gap space can reside between the endcap electrode 23 and the detector 40.

The close spatial proximity of the detector to the mass analyzer, such as the CIT described, is particularly advantageous for small mass spectrometry systems operating at high pressure (approximately >1 Torr) due to the reduced mean free paths experienced by the ejected ions at such pressures.

Figure 6A:
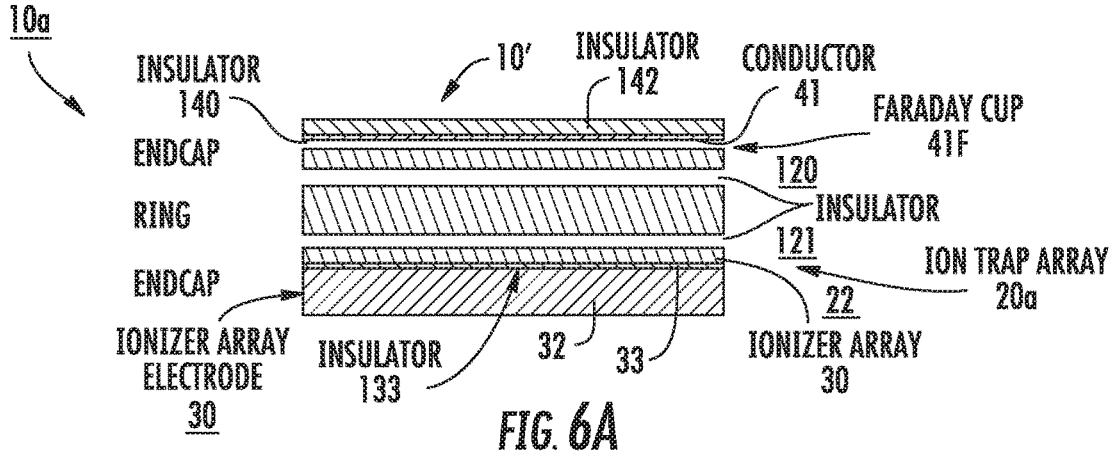
FIG. 6A is a schematic illustration of another stacked assembly according to embodiments of the present invention.

FIG. 6A illustrates another embodiment of the compact assembly 10'. In this embodiment, the ionizer array 30 shares an electrode with the CIT array 20*a*. That is, the endcap electrode 22 can also be used as the adjacent ionizer array electrode (eliminating the need for electrode 31 shown in FIG. 1) or the ionizer electrode 31 can also used as the endcap electrode 23. Thus, this assembly 10' illustrates a stacked assembly of conductors and insulators where one of the CIT endcap electrodes 23 is formed by one of the ionizer conducting electrodes 31 to reduce the complexity and overall size of the mass spectrometry assembly.

Figure 6B:
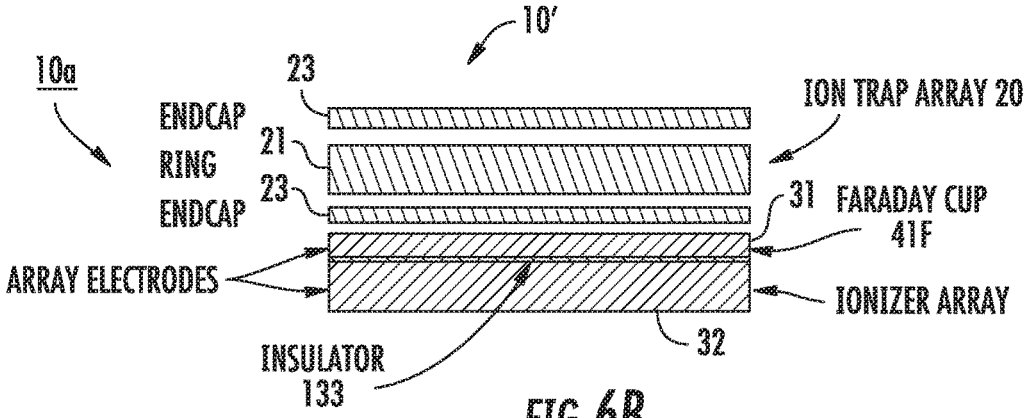
FIG. 6B is a schematic illustration of another stacked assembly according to embodiments of the present invention.

As shown in FIG. 6B, in some embodiments, the assembly 10*a* can be configured so that one or more of the at least one ionizer electrode 31 or 32 can be switched electrically and also used as the detector electrode 40, e.g., a collector electrode for the Faraday cup 41F.

Figure 8A:
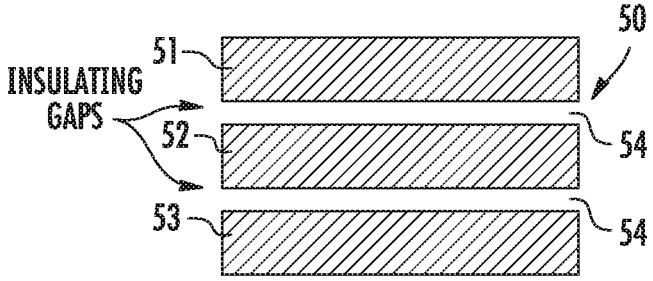
FIG. 8A is a schematic illustration of an exemplary side view of a lens array shown in FIG. 7 according to embodiments of the present invention.
Figure 8B:
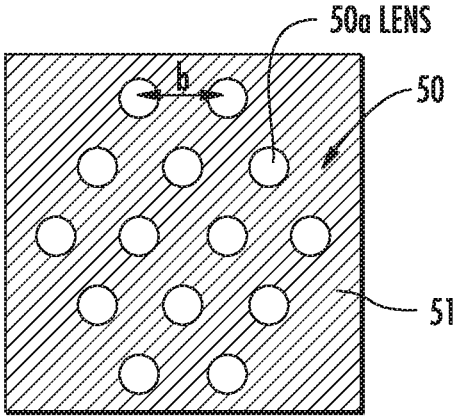
FIG. 8B is a top view of the conductive electrodes of the lens shown in FIG. 8A according to embodiments of the present invention.

As shown in FIG. 7, another element that can be used in the transport of charged particles is an Einzel lens 50. An Einzel lens 50 includes three planar annular electrodes 51, 52, 53 equally spaced about where different electric potentials are applied to the separate electrodes of the ionizer 30 so as to focus the charged particles. Insulating gaps of air/gas or solid/insulating substrate material 54 can reside between the intermediate electrode 52 and each adjacent annular end electrode 51, 53. In the case of a solid insulating substrate 54, some of the substrate material can be removed or formed so as to allow clear aperture spaces aligned with and through the one or more lens apertures 50*a*. An array of Einzel lens apertures 50*a* can be formed as shown in FIG. 8 where all of the lenses could have the same focal distance if they are all the same size. The Einzel lens array 50*a* resides between the ionizer 30 and the ion trap 20. Each lens 50*a* can have substantially the same size as corresponding apertures 21*a* of the ring electrode. The design of Einzel lenses is well known to those trained in the art of ion optics.

The features in the different conductors and insulators can be provided using any suitable method, including, but not limited to, one or more of conventional machining, drilling, milling, and CNC milling, ultrasonic milling, electrical discharge machining, deep reactive ion etching, wet chemical etching, water jet machining, laser water jet machining and laser machining Resolution in a CIT array can be limited by the precision of the fabrication technique utilized. Variations in hole diameter, placement and alignment between electrodes 21, 22, 23 can cause small differences between individual traps resulting in decreased resolution for the array 20*a*. Thus, precision fabrication may be preferred so that tolerances are within a high degree of accuracy. A MEMS fabrication process such as bulk micromachining or surface micromachining can be used where semiconductor materials are used to form the conductor and/or insulator components.

Figure 9:
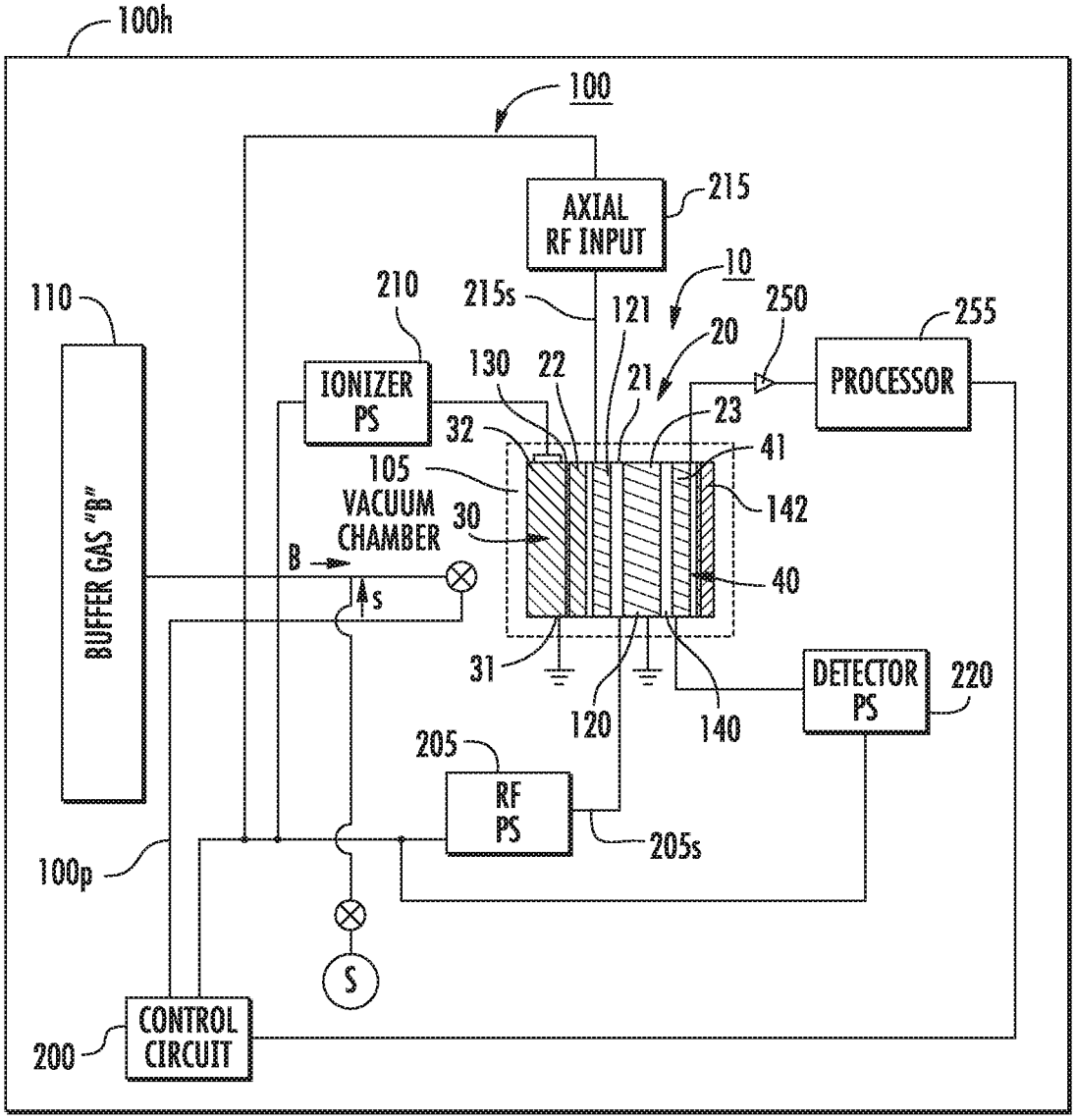
FIG. 9 is schematic illustration of a mass spectrometry system with a stacked assembly of MS components (ion source, analyzer and detector) according to embodiments of the present invention.

FIG. 9 illustrates a portable MS system 100 with a housing 100*h* that encloses the assembly 10, typically inside a chamber 105, which may comprise at least one vacuum chamber (the chamber is shown by the broken line around the stacked assembly 10).

In some embodiments, the housing 100*h* can releasably attach a canister 110 of pressurized buffer gas "B" that connects to a flow path into the (vacuum) chamber 105. The housing 100*h* can hold a control circuit 200 and various power supplies 205, 210, 215, 220 that connect to conductors to carry out the ionization, mass analysis and detection. The housing 100*h* can hold one or more amplifiers including an output amplifier 250 that connects to a processor 255 for generating the mass spectra output.

The portable system 100 can be lightweight, typically between about 1-15 pounds (not including a vacuum pump, where used), inclusive of the buffer gas supply 110, where used. The housing 100*h* can be configured as a handheld housing, such as having a form factor similar in size and weight as a Microsoft® Xbox®, Sony® PLAYSTATION® or Nintendo® Wii® game console or game controller, or similar to a form factor associated with an electronic notebook, PDA, IPAD or smartphone and may optionally have a pistol grip 100*g* that holds the control circuit 200. However, other configurations of the housing may be used as well as other arrangements of the control circuit. The housing 100*h* typically holds a display screen and can have a User Interface such as a Graphic User Interface.

The system 100 may also include a transceiver, GPS module and antenna and can be configured to communicate with a smartphone or other pervasive computing device (laptop, electronic notebook, PDA, IPAD, and the like) to transfer data or for control of operation, e.g., with a secure APP or other wireless programmable communication protocol.

The system 100 can be configured to operate at pressures at or greater than about 100 mTorr up to atmospheric.

In some embodiments, the mass spectrometer 100 is configured so that the ion source (ionizer) 30, mass analyzer 20 and detector 40 operate at near isobaric conditions and at a pressure that is greater than 100 mTorr. The term "near isobaric conditions" include those in which the pressure between any two adjacent chambers differs by no more than a factor of 100, but typically no more than a factor of 10.

Figure 10:
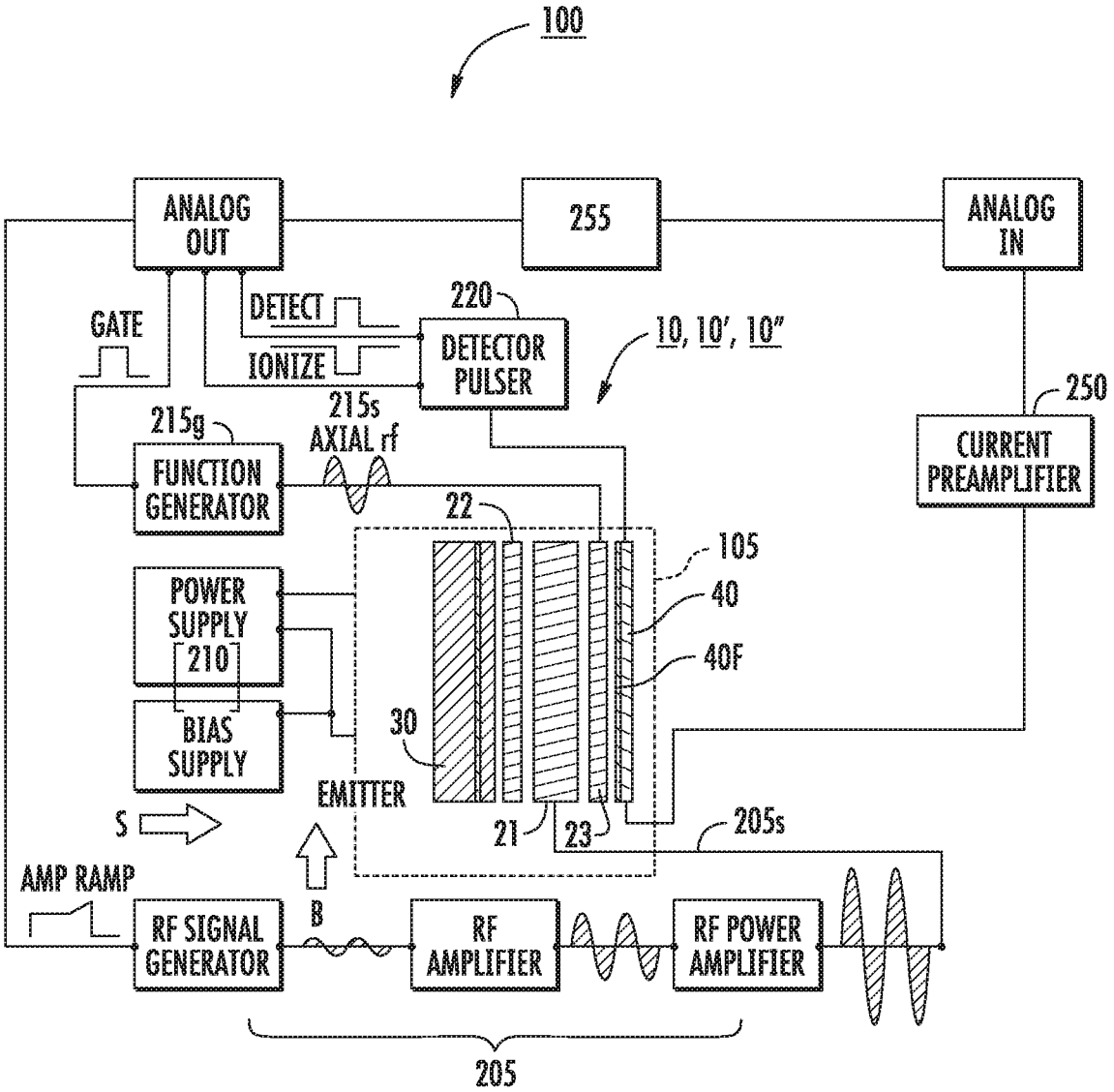
FIG. 10 is a block diagram of a mass spectrometry system according to embodiments of the present invention.

As shown in FIG. 10, the spectrometer 100 can include the stacked assembly 10 and an arbitrary function generator 215*g* to provide a low voltage axial RF input 215 to the ion trap 20 during mass scan for resonance ejection. The low voltage axial RF can be between about 100 mVpp to about 8000 mVpp, typically between 200 to 2000 mVpp. The axial RF 215*s* can be applied to a CIT endcap 22 or 23, typically end cap 23, or between the two endcaps 22 and 23 during a mass scan for facilitating resonance ejection.

As shown in FIGS. 9 and 10, the device 100 includes an RF power source 205 that provides an input signal to the ring electrode 21. The RF source 205 can include an RF signal generator, RF amplifier and RF power amplifier. Each of these components can be held on a circuit board in the housing 100*h* enclosing the ion trap 20 in the vacuum chamber 105. In some embodiments, an amplitude ramp waveform can be provided as an input to the RF signal generator to modulate the RF amplitude. The low voltage RF can be amplified by a RF preamplifier then a power amplifier to produce a desired RF signal. The RF signal can be between about 1 MHz to 1000 MHz depending on the size of the ring electrode features. As is well known to those trained in the art, the RF frequency depends reciprocally on the ring electrode radius, $r_0$. A typical RF frequency for an $r_0$ of 500 μm would be 5-20 MHz. The voltages can be between 100 $V_{0p}$ to about 1500 $V_{0p}$, typically up to about 500 $V_{0p}$.

Generally stated, electrons are generated in a well-known manner by source 30 and are directed towards the mass analyzer (e.g., ion trap) 20 by an accelerating potential. Electrons ionize sample gas S in the mass analyzer 20. For ion trap configurations, RF trapping and ejecting circuitry is coupled to the mass analyzer 20 to create alternating electric fields within ion trap 20 to first trap and then eject ions in a manner proportional to the mass to charge ratio of the ions. The ion detector 40 registers the number of ions emitted at different time intervals that correspond to particular ion masses to perform mass spectrometric chemical analysis. The ion trap dynamically traps ions from a measurement sample using a dynamic electric field generated by an RF drive signal 205*s*. The ions are selectively ejected corresponding to their mass-charge ratio (mass (m)/charge (z)) by changing the characteristics of the radio frequency (RF) electric field (e.g., amplitude, frequency, etc.) that is trapping them. These ion numbers can be digitized for analysis and can be displayed as spectra on an onboard and/or remote processor 255.

In the simplest form, a signal of constant RF frequency 205*s* can be applied to the center electrode 21 relative to the two end cap electrodes 22, 23. The amplitude of the center electrode signal 205*s* can be ramped up linearly in order to selectively destabilize different m/z of ions held within the ion trap. This amplitude ejection configuration may not result in optimal performance or resolution. However, this amplitude ejection method may be improved upon by applying a second signal 215*s* differentially across the end caps 22, 23. This axial RF signal 215*s*, where used, causes a dipole axial excitation that can result in the resonant ejection of ions from the ion trap when the ions' secular frequency of oscillation within the trap matches the end cap excitation frequency.

The ion trap 20 or mass filter can have an equivalent circuit that appears as a nearly pure capacitance. The amplitude of the voltage 205*s* to drive the ion trap 20 may be high (e.g., 100 V-1500 Volts) and can employ a transformer coupling to generate the high voltage. The inductance of the transformer secondary and the capacitance of the ion trap can form a parallel tank circuit. Driving this circuit at resonant frequency may be desired to avoid unnecessary losses and/or an increase in circuit size.

The vacuum chamber 105 can be in fluid communication with at least one pump (not shown). The pumps can be any suitable pump such as a roughing pump and/or a turbo pump including one or both a TPS Bench compact pumping system or a TPS compact pumping system from Varian (now Agilent Technologies). The pump can be in fluid communication with the vacuum chamber 105. In some embodiments, the vacuum chamber can have a high pressure during operation, e.g., a pressure greater than 100 mTorr up to atmospheric. High pressure operation allow elimination of high-vacuum pumps such as turbo molecular pumps, diffusion pumps or ion pumps. Operational pressures above approximately 100 mTorr can be easily achieved by mechanical displacement pumps such as rotary vane pumps, reciprocating piston pumps, or scroll pumps.

Sample S may be introduced into the vacuum chamber 105 with a buffer gas B through an input port toward the ion trap 20. The S intake from the environment into the housing 100*h* can be at any suitable location (shown by way of example only from the bottom). One or more Sample intake ports can be used.

The buffer gas B can be provided as a pressurized canister 110 of buffer gas as the source. However, any suitable buffer gas or buffer gas mixture including air, helium, hydrogen, or other gas can be used. Where air is used, it can be pulled from atmosphere and no pressurized canister or other source is required. Typically, the buffer gas comprises helium, typically above about 90% helium in suitable purity (e.g., 99% or above). A mass flow controller (MFC) can be used to control the flow of pressurized buffer gas B from pressurized buffer gas source 110 with the sample S into the chamber 105. When using ambient air as the buffer gas, a controlled leak can be used to inject air buffer gas and environmental sample into the vacuum chamber. The controlled leak design would depend on the performance of the pump utilized and the operating pressure desired.

Figure 11:
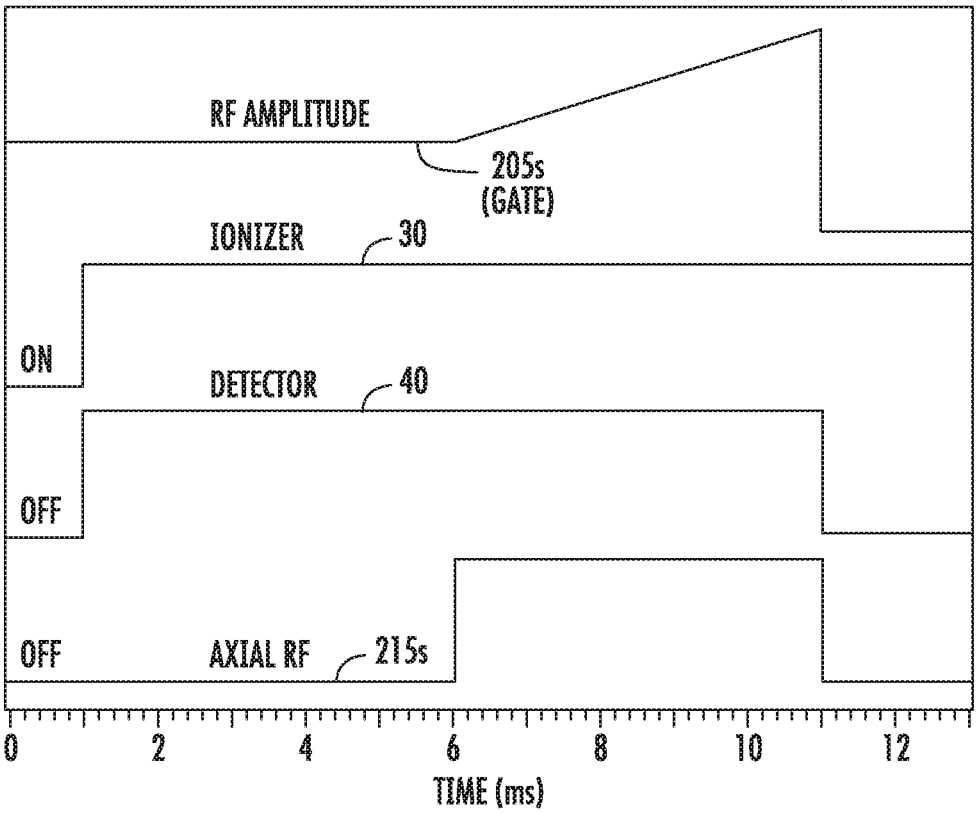
FIG. 11 is an exemplary timing diagram of a mass spectrometry system according to some embodiments of the present invention.

FIG. 11 illustrates an exemplary timing diagram that can be used to carry out/control various components of the mass spectrometer 100. The drive RF amplitude signal can be driven using a ramp waveform that modulates the RF amplitude throughout the mass scan and the other three pulses control ionization, detection and axial RF voltages applied. As shown, initially, 0 V can optionally be applied to the gate lens 50 (where used) to allow electrons to pass through during the ionization period. Alternatively, this signal can be applied to the ionizer 30 directly to turn on and off the production of electrons or ions. The drive RF amplitude 205*s* can be held at a fixed voltage during an ionization period to trap ions generated inside the CIT 20. At the end of the ionization period, the gate lens voltage (if used) is driven to a potential to block the electron beam of the ionizer 30 and stop ionization. The drive RF amplitude 205*s* can then be held constant for a defined time, e.g., about 5 ms, to allow trapped ions to collisionally cool towards the center of the trap. The drive RF amplitude 205*s* can be linearly ramped to perform a mass instability scan and eject ions toward the detector 40 in order of increasing m/z. The axial RF signal 215*s* can be synched to be applied with the start of ramp up of the RF amplitude signal linear ramp up (shown at t=6 ms, but other times may be used) so as to be substantially simultaneously gated on to perform resonance ejection during the mass scan for improved resolution and mass range. Data is acquired during the mass instability scan to produce a mass spectrum. Finally, the drive RF amplitude 205*s* can be reduced to a low voltage to clear any remaining ions from the trap 20 and prepare it for the next scan. A number of ion manipulation strategies can be applied to ion trap devices such as CITs, as is well known to those trained in the art. All of the different strategies to eject, isolate, or collisionally dissociate ions can be applied to the ion trapping structures discussed in the application.

Figure 12:
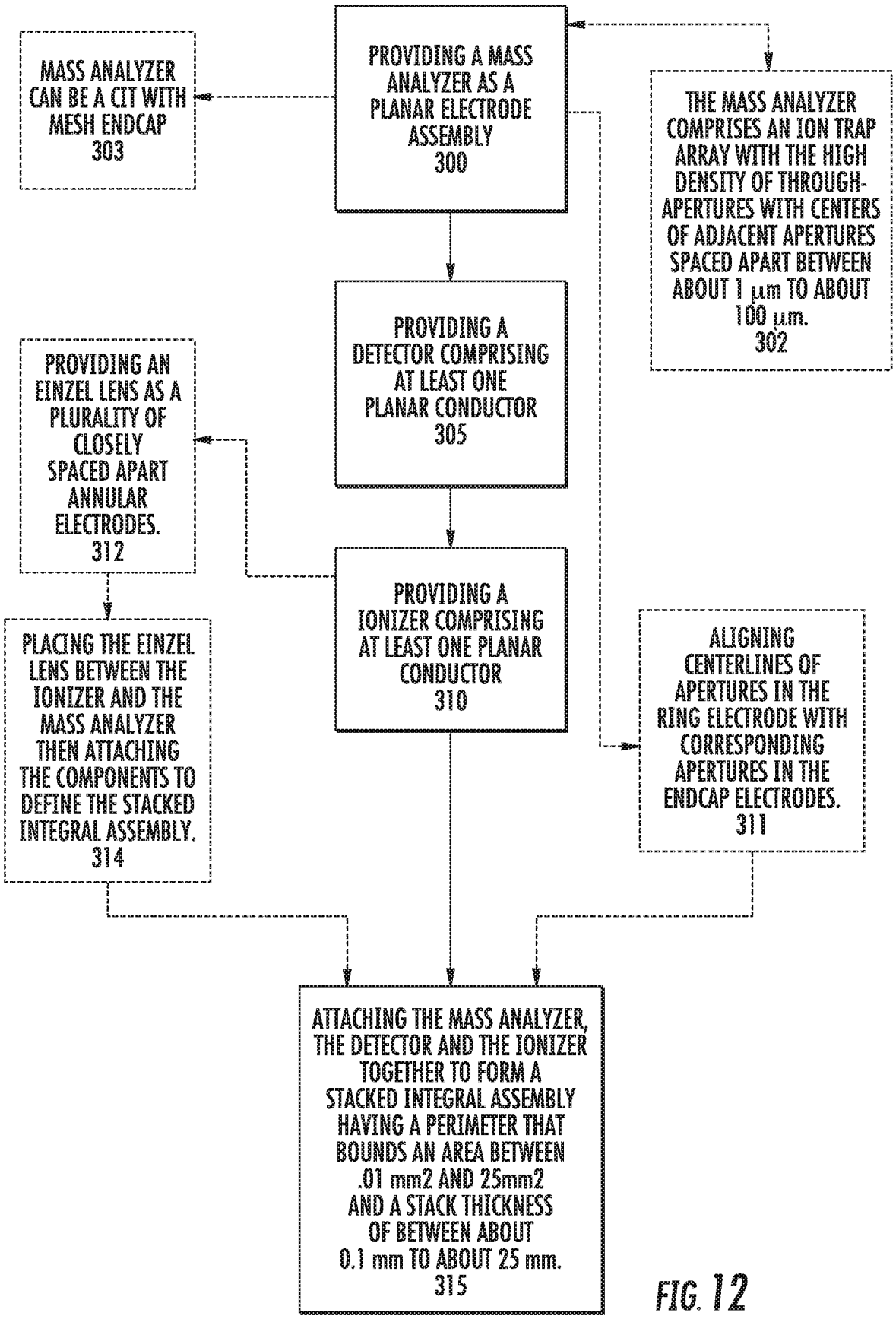
FIG. 12 is a flow chart of operations that can be used to fabricate an assembly for a mass spectrometry system according to embodiments of the present invention.

FIG. 12 is a flow chart of exemplary fabrication steps that can be used to assemble planar components to form a compact assembly for a mass spectrometry system. As shown, a mass analyzer can be provided as a plurality of closely stacked, spaced apart planar electrodes (block 300). The mass analyzer can be preassembled or assembled with the assembly of the other components. A detector comprising at least one planar conductor can be provided (block 305). The planar conductor can be provided as a silicon wafer that contains signal processing electronics. Optionally, the detector can include a planar insulator, but this is not required for embodiments including a separate electronic collector. An ionizer 30 can include one or more planar conductors (block 310). Optionally, the ionizer can include more than one conductor such as a pair of conducting electrodes on opposing sides of an insulating spacer as described above. The mass analyzer, the detector and the ionizer can be attached together to form a stacked integral assembly having a perimeter with each side having a size between 0.1 mm to about 10 cm, more typically between about 1 mm to 5 cm and a stack thickness of between about 0.1 mm to about 25 mm (block 315).

The stacked assembly can comprise a high density of through apertures with centers of adjacent apertures spaced apart between about 1 μm to about 5000 μm (block 302).

The centerlines of apertures in the ring electrode can be aligned with corresponding apertures in the endcap electrodes during or before the attaching step (block 311).

The method can include providing an Einzel lens as a plurality of closely spaced apart annular electrodes (block 312). The Einzel lens array can be placed between the ionizer and the mass analyzer, then attaching the components to define the stacked integral assembly (block 314).

Embodiments described herein operate to reduce the power and size of a mass spectrometer so that the mass spectrometer system 10 may become a component in other systems that previously could not use such a unit because of cost and the size of conventional units.

One or more mass spectrometers 10 may be placed in or at a hazard site to analyze gases and remotely send back a report of conditions presenting danger to personnel. A mass spectrometer 10 may be placed at strategic positions on air or land transport to test the environment for hazardous gases that may be an indication of malfunction or even a terrorist threat. Embodiments of the present invention provide mass spectrometers suitable for handheld, field use.

Embodiments of the present invention may take the form of software and hardware aspects, all generally referred to herein as a "circuit" or "module." The processor can include one or more digital microprocessors.

As will be appreciated by one of skill in the art, features or embodiments of the present invention may be embodied as an apparatus, a method, data or signal processing system, or computer program product. Furthermore, certain embodiments of the present invention may include an Application Specific Integrated Circuit (ASIC) and/or computer program product on a computer-usable storage medium having computer-usable program code means embodied in the medium. Any suitable computer readable medium may be utilized including hard disks, CD-ROMs, optical storage devices, or magnetic storage devices.

The computer-usable or computer-readable medium may be, but is not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium, upon which the program is printed, as the program can be electronically captured, via, for instance, optical scanning of the paper or other medium, then compiled, interpreted or otherwise processed in a suitable manner if necessary, and then stored in a computer memory.

Computer program code for carrying out operations of the present invention may be written in an object oriented programming language such as Java7, Smalltalk, Python, Labview, C++, or VisualBasic. However, the computer program code for carrying out operations of the present invention may also be written in conventional procedural programming languages, such as the "C" programming language or even assembly language. The program code may execute entirely on the spectrometer computer and/or processor, partly on the spectrometer computer and/or processor, as a stand-alone software package, partly on the spectrometer computer and/or processor and partly on a remote computer, processor or server or entirely on the remote computer, processor and/or server. In the latter scenario, the remote computer, processor and/or server may be connected to the spectrometer computer and/or processor through a LAN or a WAN, or the connection may be made to an external computer, processor and/or server (for example, through the Internet using an Internet Service Provider).

The flowcharts and block diagrams of certain of the figures herein illustrate the architecture, functionality, and operation of possible implementations of mass spectrometers or assemblies thereof and/or programs according to the present invention. In this regard, each block in the flow charts or block diagrams represents a module, segment, operation, or portion of code, which comprises one or more executable instructions for implementing the specified logical function(s). It should also be noted that in some alternative implementations, the functions noted in the blocks might occur out of the order noted in the figures. For example, two blocks shown in succession may in fact be executed substantially concurrently or the blocks may sometimes be executed in the reverse order, depending upon the functionality involved.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed:

1. A mass spectrometry system, comprising:

an ionizer comprising at least one planar conductor;

a mass analyzer comprising a planar electrode assembly, wherein the planar electrode assembly comprises a first electrode defining a plurality of apertures for trapping charged particles in the mass analyzer; and a detector comprising at least one planar conductor, wherein the ionizer, the mass analyzer and the detector form a stacked assembly;

wherein the plurality of apertures each have a cross-sectional shape, and the cross-sectional shapes define a diameter or an average effective diameter for the plurality of apertures; and wherein a nearest neighbor spacing among the plurality of apertures is at least 50% larger than the diameter or the average effective diameter for the plurality of apertures.

2. The system of claim 1, wherein a thickness of the first electrode defining the plurality of apertures, measured along an axial direction of the system, is greater than 500 μm.

3. The system of claim 2, wherein the thickness of the first electrode is 790 μm or less.

4. The system of claim 1, wherein the plurality of apertures comprises at least 10 apertures.

5. The system of claim 1, wherein the plurality of apertures are positioned to form a hexagonal array of apertures in the first electrode.

6. The system of claim 1, wherein each of the plurality of apertures has a circular cross-sectional shape.

7. The system of claim 1, wherein one or more members of the plurality of apertures has a non-circular cross-sectional shape.

8. The system of claim 1, wherein the nearest neighbor spacing among the plurality of apertures is at least 100% larger than the average effective diameter for the plurality of apertures.

9. The system of claim 1, further comprising a second electrode positioned between the mass analyzer and the detector, wherein the second electrode comprises an array of apertures, and wherein cross-sectional shapes and/or sizes of at least some of the apertures of the second electrode are different from cross-sectional shapes and/or sizes of at least some of the apertures of the first electrode.

10. The system of claim 9, wherein one or more apertures of the second electrode are aligned with one or more corresponding apertures of the first electrode along directions parallel to an axial direction of the system.

11. The system of claim 9, wherein one or more apertures of the second electrode are not aligned with apertures of the first electrode.

12. The system of claim 1, wherein the nearest neighbor spacing among the plurality of apertures is uniform in the first electrode.

13. The system of claim 1, further comprising:

a chamber enclosing the ionizer, the mass analyzer, and the detector; and a vacuum source connected to the chamber and configured to control gas pressure within the chamber so that during operation of the system, the ionizer, mass analyzer, and detector operate at a pressure greater than 100 mTorr.

14. The system of claim 13, wherein during operation of the system, the ionizer, mass analyzer, and detector operate at near isobaric conditions.

15. The system of claim 1, further comprising:

a first endcap electrode positioned between the ionizer and the first electrode and spaced a distance $d_1$ from the first electrode; and a second endcap electrode positioned between the first electrode and the detector and spaced a distance $d_2$ from the first electrode, wherein at least one region between the first endcap electrode and the first electrode, and between the first electrode and the second electrode, is filled with an insulating material.

16. The system of claim 15, wherein the insulating material comprises a gas.

17. The system of claim 15, wherein $d_1$ and $d_2$ are different.

18. The system of claim 15, wherein each of the first and second endcap electrodes comprises a plurality of apertures, and wherein a diameter or an average effective diameter for the plurality of apertures of the first endcap electrode is 40% or less of the diameter or the average effective diameter for the plurality of apertures of the first electrode.

19. The system of claim 15, wherein cross-sectional shapes and/or sizes of at least some members of the plurality of apertures of the first endcap electrode are different from cross-sectional shapes and/or sizes of at least some members of the plurality of apertures of the first electrode.

20. A method of measuring mass spectral information, the method comprising:

introducing a sample into a mass spectrometry system, the mass spectrometry system comprising:

an ionizer comprising at least one planar conductor;

a mass analyzer comprising a planar electrode assembly, wherein the planar electrode assembly comprises a first electrode defining a plurality of apertures for trapping charged particles in the mass analyzer; and a detector comprising at least one planar conductor;

ionizing the sample using the ionizer of the mass spectrometry system to generate charged particles; and detecting the charged particles using the detector of the mass spectrometry system and determining mass spectral information about the sample based on the detected charged particles, wherein the ionizer, the mass analyzer and the detector form a stacked assembly;

wherein the plurality of apertures each have a cross-sectional shape, and the cross-sectional shapes define a diameter or an average effective diameter for the plurality of apertures; and wherein a nearest neighbor spacing among the plurality of apertures is at least 50% larger than the diameter or the average effective diameter for the plurality of apertures.

* * * * *